United States Patent [19]

Golembeck et al.

[11] 4,038,711

[45] Aug. 2, 1977

[54] SPRING ASSEMBLIES AND PREFABRICATED SUB-ASSEMBLIES FOR MANUFACTURE THEREOF

[75] Inventors: Gerald A. Golembeck, Lake Elmo; Ralph J. Marx, St. Paul, both of Minn.

[73] Assignee: The United States Bedding Company, St. Paul, Minn.

[21] Appl. No.: 649,710

[22] Filed: Jan. 16, 1976

[51] Int. Cl.[2] ..... A47C 23/02

[52] U.S. Cl. ..... 5/263; 5/239

[58] Field of Search ..... 5/263, 239, 257, 270, 5/274; 24/73 HS, 73 SS, 114, 129

[56] References Cited

U.S. PATENT DOCUMENTS

| | | | |
|---|---|---|---|
| 89,514 | 4/1869 | Stevens et al. | 24/115 J |
| 568,101 | 9/1896 | Rouse | 5/259 R |
| 570,425 | 10/1896 | Colvin | 5/284 X |
| 1,545,461 | 7/1925 | Trimble | 5/264 R |
| 1,746,942 | 2/1930 | Hise | 5/270 |
| 2,021,506 | 11/1935 | Hamilton | 5/256 X |
| 2,332,042 | 10/1943 | Asaro | 5/264 R |
| 2,979,739 | 4/1961 | Krakauer | 5/351 X |
| 3,089,154 | 5/1963 | Boyles | 5/248 X |
| 3,681,794 | 8/1972 | Ciampa et al. | 5/263 X |

*Primary Examiner*—Paul R. Gilliam
*Assistant Examiner*—Andrew M. Calvert
*Attorney, Agent, or Firm*—McDougall, Hersh & Scott

[57] ABSTRACT

A spring assembly formed of multiple coil springs arranged in lengthwise and crosswise rows and a sub-assembly for use in the manufacture of such spring assemblies in which the sub-assembly is formed of elongate slats having longitudinally spaced nodules extending from the upper surfaces thereof for mounting coil springs thereon in corresponding longitudinally spaced relation with the coil springs extending upwardly from the top surface of the slats.

6 Claims, 8 Drawing Figures

FIG. 1
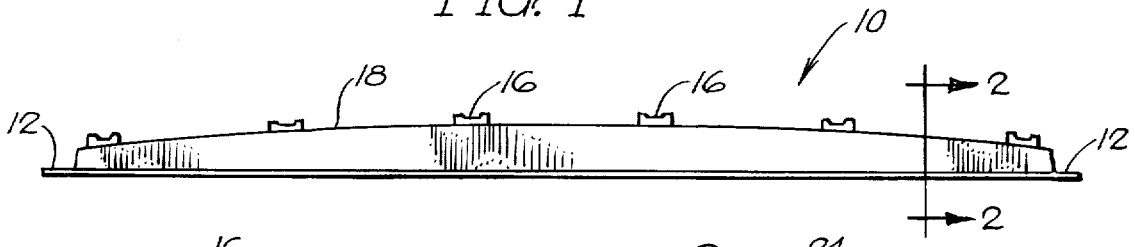
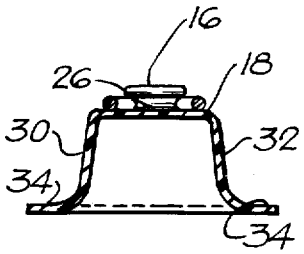
FIG. 2
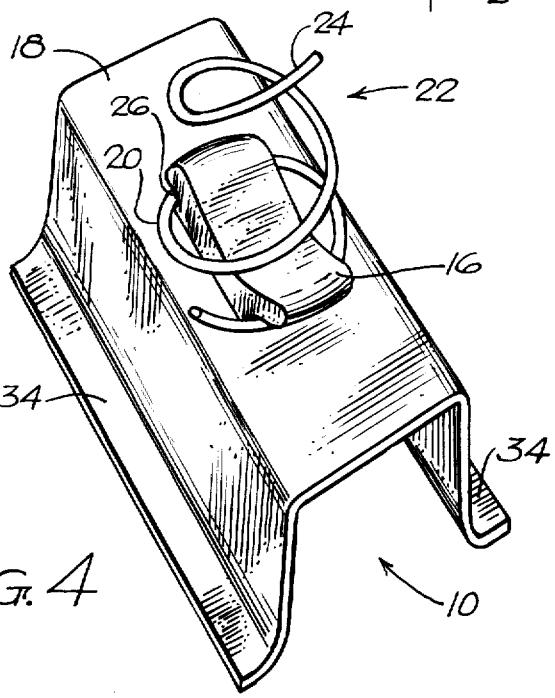
FIG. 4
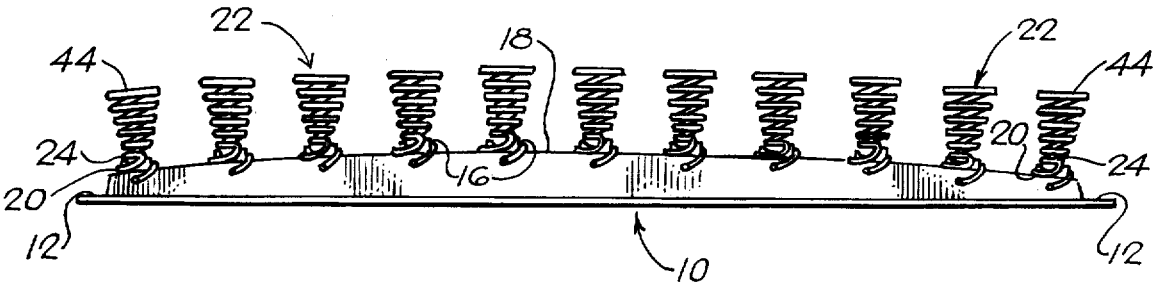
FIG. 3

FIG. 5
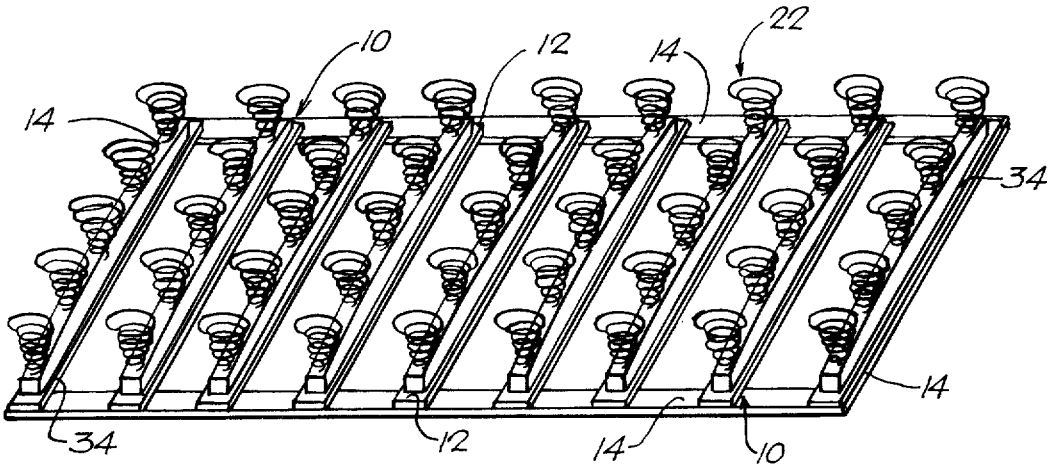
FIG. 6
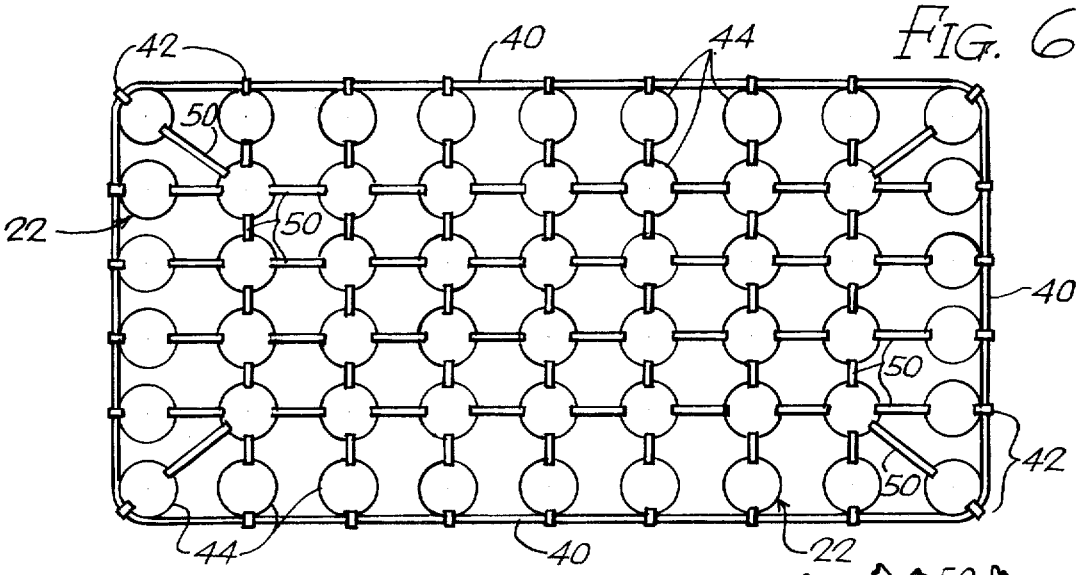
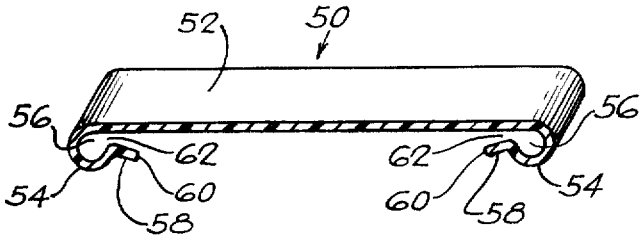
FIG. 7
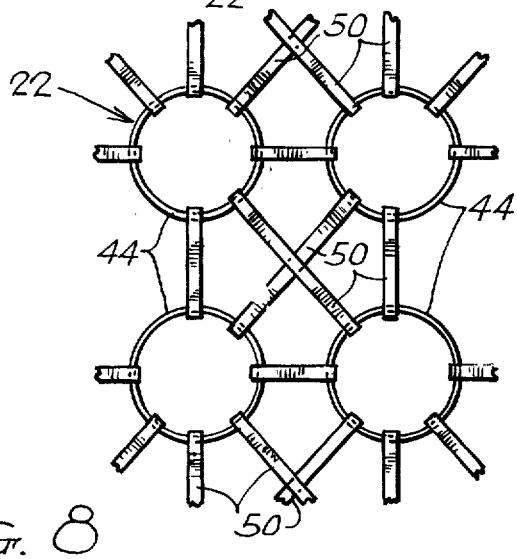
FIG. 8

SPRING ASSEMBLIES AND PREFABRICATED SUB-ASSEMBLIES FOR MANUFACTURE THEREOF

This invention relates to spring assemblies and to sub-assemblies for use in the manufacture of spring assemblies such as box springs and mattresses, which sub-assemblies may be pre-assembled for automatic or manual assembly into such spring assemblies of various types and applications.

It is an object of this invention to produce sub-assemblies in the form of elongate slats having coil springs pre-assembled thereon whereby such sub-assemblies can be mass produced in various lengths, and assembled in various combinations and arrangements, to produce spring assemblies having selected construction of coil springs in a predetermined arrangement for box springs and the like of different sizes and different degrees of stiffness; in which such sub-assemblies can be produced in a simple and efficient manner, on a mass production basis, without the need for highly skilled labor complicated equipment; in which such sub-assemblies can be produced to different lengths with little chance of error and of relatively inexpensive and readily available materials for use in the manufacture of spring assemblies of low cost and improved operating characteristics; in which such sub-assemblies can be assembled in various arrangements to produce spring assemblies of variable characteristics, and in which such sub-assemblies can be assembled in a simple and efficient manner, manually or with automatic equipment, to produce spring assemblies for various uses, of various size, with variable concentration of coil springs for variable amounts of thickness, but always with improved performance as a foundation for cushioning and upholstery material in the manufacture of mattresses, box springs, seat cushions, back cushions and the like spring supported elements; in which considerable variation in product type can be obtained with minimum inventory by reason of the flexibility in the utilization of the sub-assemblies for springs of various purposes, sizes and coil concentration, and finally in which metal to metal contact is substantially completely eliminated thereby to produce a spring assembly which is quiet in position of use.

These and other objects and advantages of this invention will hereinafter appear and, for purpose of illustration, but not of limitation, an embodiment of the invention is shown in the accompanying drawings in which FIG. 1 is a side elevational view of a molded slat which forms the base of a sub-assembly embodying the features of this invention;

FIG. 2 is a sectional view taken along the line 2—2 of FIG. 1;

FIG. 3 is a side elevational view of the slat as shown in FIG. 1 with the coil springs assembled thereon to form the sub-assembly of this invention;

FIG. 4 is a perspective view, which is enlarged to show the means for mounting the coil springs onto the slat in the spring assembly;

FIG. 5 is a perspective view showing the base frame with the sub-assembly mounted thereon as an intermediate step in the fabrication of the final spring assembly;

FIG. 6 is a top plan view showing the completed spring assembly embodying the features of this invention;

FIG. 7 is a perspective view of a clip embodying the features of this invention for interconnecting terminal coils of the coil springs in the assembly; and FIG. 8 is a view similar to that of FIG. 7 showing the different arrangements of cross-tying clip members for different spring assemblies.

Referring now to the drawings, each sub-assembly comprises an elongate slat 10 molded, extruded or cast of a rigid plastic material with flattened end portions 12 for attachment of the slat onto frame members 14 to extend crosswise between frame members. Such attachment can be achieved by screws extending through screw holes in the end portion for securing the slats down onto the frame members or attachment can be achieved by nailing down onto the frame member or by means of clips, adhesive or other conventional fastening means to fix the ends of the slats onto the underlying top surfaces of the frame member.

The slats 10 are dimensioned to have a length corresponding to the space between the side frame members 14 whereby the slats extend crosswise in the spring assembly, or they may be dimensioned to correspond with the spaced relation between the end frame members whereby the slats will extend lengthwise in the spring assembly.

In the use of the sub-assembly in the manufacture of box springs or mattresses, the spaced relation between the side frame members will depend upon whether the spring assembly is to be used for a twin, full, queen, or king sized bed, such that slats of four different lengths would be provided for the bedding industry.

Each slat 10 is formed with longitudinally spaced nodules 16 projecting upwardly from the top surface 18 of the slat, with the nodules dimensioned to be entwined by the lowermost coil 20 of the coil spring 22 releasably to secure the coil spring onto the slat 10 in position to extend upwardly from the top surface thereof.

The coil springs 22 can be of the conventional hourglass, cylindrical, or conical shaped types but, as in the illustrated modification, it is preferred to make use of coil springs of conical shape with the end portion 24 of smallest diameter secured onto the nodules 16 whereby the terminal coils of the largest dimension are uppermost to provide maximum support for the overlying layer or layers of cushioning material in the final assembly.

The nodules 16 can be of any configurations from round to polygonal shape in crosswise section, but it is preferred to make use of nodules of substantially elliptical or rectangular shape with the longest dimension extending lengthwise of the slat and corresponding with the diameter of the lowermost coil 24 of the coil spring so that the lowermost coil will engage the lowermost portions of the nodules where the nodules merge into the top surface of the slat. To enhance the gripping relationship, the walls of the nodules may be formed to arcuate section to correspond with the curvature of the coils and it is preferable to form the nodules with the lowermost portions 26 inset to provide recessed portions at the base for receiving the lowermost terminal coil of the coil spring in nesting relation therein. However, it is sufficient, as shown in the drawings, to form the nodule with end walls that are inclined slightly outwardly from the base to the upper edge.

The nodules are longitudinally spaced along the slat by an amount corresponding to the desired spaced relation between the coil springs in the crosswise and lengthwise extending rows of the spring assembly, depending on whether the slats extend crosswise or lengthwise in the frame.

In assembly, the coil springs 22 can be positioned with the lowermost coil 24 vertically aligned with nodule 16, after which pressure is applied to force the lowermost coil of the coil spring down onto the nodule for entry of the nodule into the coil spring as the lowermost coil is displaced about the nodule to the base thereof. Thus the lowermost coil of the coil spring embraces the nodule to establish a gripping relationship releasably to fix the coil spring onto the nodule.

Where, as in the preferred practice of this invention, the lowermost coil 24 of the coil spring 22 is formed with an open end whereby the spring wire forming the lowermost coil is in the form of an open helix, the lowermost coil of the coil spring can be screwed onto the nodule by bringing the lowermost coil into engagement with the nodule and then twisting the coil spring, such as in a clockwise direction, whereby the helical end portion will screw onto the nodule until the lowermost portion of the coil spring comes into engagement with the slat. Thus the coil springs can simply be spun onto the nodules to assemble the coil springs onto the nodules with a strong gripping relation therebetween.

The slats can be formed with a flat top surface 18 from which the nodules extend, but it is preferred to form the slats with a slight rise from the ends towards the middle to provide a crown at the center of about ½ to 1½ inches. This operates to give added strength and a desirable crown to the spring assembly and to the box spring or mattress that is formed thereof.

While the slats may be cast or molded to any desired shape in cross-section, the desired rigidity can be achieved with a minimum amount of material and weight when the slats are molded of an elongate strip or extruded to provide a cross-section in the form of an inverted U having spaced side walls 30 and 32 extending downwardly from the lateral edges of the top wall 18, with flanges 34 extending outwardly from the lower edges of the side walls to form a beam, but in which the inverted U shaped body portion may be rounded to the shape of liberty bell or the like in cross-section. Instead of molding the slats of plastic material, use can also be made of slats formed of wood or laminates.

As described, the sub-assemblies, with the coil springs mounted thereon in position of use, can be fabricated in large numbers in advance to provide an inventory of various sized sub-assemblies for subsequent use in the manufacture of spring assemblies for box springs, mattresses, chair seats, upholstered furniture and the like.

When it is desired to make use of the sub-assemblies in the manufacture of a spring assembly, such as a box spring, a base frame 14 is first provided with dimensions to correspond to the perimeter of the spring assembly. The base frame may be formed of wood, plastic or the like material to which the ends 12 of the slats 10 can be secured. A frame one board high can be formed by gang-nailing the adjacent end or a frame two boards high can be formed by nailing the overlapping end portion of the crosswise frame members onto the ends of the lengthwise frame members.

The sub-assemblies are then positioned with the ends 12 of the slats 10 resting on the opposite frame members 14 with the slats arranged in the desired spaced relation therebetween to provided the desired spring count in the final spring assembly. The end of the slats are then secured by staples, nails, screws or other fastening means to the underlying portions of the frame members to fix the slats in position of use.

Thereafter, in a box spring assembly or in a mattress, a border wire 40 is positioned about the uppermost coils of the outermost coil springs in the assembly and secured thereto by conventional means, such as by helical tie wires, clips 42, or the like.

The loose upper terminal coils 44 of the coil springs 22 are interconnected one with another in the assembly by means of clips 50 which extend crosswise in various patterns between adjacent coil springs.

In accordance with a concept of this invention the clips are formed of elongate strips of metal, and preferably of plastic material having a body portion 52 dimensioned to correspond with the distance between the terminal coils 44 to be interconnected, with the body portion 52 terminating in a reversely bent end portion 54 to provide spaced inwardly facing channel sections 56 adatped to receive the wire of the adjacent coil springs in seated relation therein.

The reversely bent end portions 54 are turned back through an angle greater than 180° and are formed to curvilinear shape to provide outermost channels 56 dimensioned to receive the wire of the terminal coil in gripping relation therein. An intermediate portion 58 extends in the direction towards the body portion 52 to provide a restricted portion spaced from the body portion by an amount less than the thickness of the wire. The reversely bent end portion terminates in a lip and portion 60 which extends curvilinearly in the direction away from the body portion 52 to provide an entrant portion 62. The border wire can be led into the channel portion through the entrant portion 62 whereafter it snaps into the channel section 56 as it clears the restricted portion to effect the assembled relation.

The pattern of clipping can take various forms, as illustrated in FIG. 6, depending upon the support desired at the surface of the spring assembly.

It will be understood that instead of making use of the sub-assembly with frame members in the assembly of a box spring for mattresses and the like, such assemblies can be used to produce spring assemblies for chair seats, back cushions and the like. For this purpose, the slats of the sub-assemblies are formed to seat dimension and the sub-assemblies are secured to the sub-frames for the seat in the manner described. When used as a seat cushion or back cushion, a border wire is not necessary by it is desirable to interconnected to the upper terminal coil of the coil springs with clips and the like members.

It will be apparent from the foregoing that the invention provides a number of benefits including:

1. quality control by standardization of sub-assemblies;

2. the ability to make use of unskilled or even handicapped labor in the routine assembly of the sub-assemblies and spring assemblies manufactured thereof; 3. the adaptability of the manufacture of sub-assemblies to automation thereby materially to reduce the cost of the final product;

4. the flexibility in assembly to increase or decrease the number, the spacing, or the arrangement of sub-assemblies to enable wide variation in product type without the need to increase the number of sub-assembly nodules;

5. the built-in crown, which strengthens the spring assemblies and prevents flattening of the type which renders the spring assembly unfit for use; and 6. the elimination of noise in use by reason of the elimination of metal to metal contact between elements making up the spring assembly.

It will be understood that changes may be made in the details of construction, arrangement and operation without departing from the spirit of the invention, especially as defined in the following claims.

We claim:

1. A sub-assembly for use in the manufacture of spring assemblies comprising an elongate slat of relatively rigid material, a plurality of longitudinally spaced nodules projecting upwardly from the top surface of the slat, a plurality of helical ciol springs, a lowermost coil of a coil spring being entwined about each nodule releasably to secure the coil springs onto the slat to extend upwardly from the top surface thereof in a longitudinally spaced apart relation corresponding to the longitudinally spaced relation between nodules, said nodules having an upper portion spaced from the slat dimensioned to have a length corresponding to the cross section of the lowermost coil and a portion of lesser cross section between said upper portion and the slat to provide a recessed portion in which the terminal coil of the coil spring is seated releasably to secure the coil spring onto the nodule.

2. A sub-assembly as claimed in claim 1 in which the coil springs are screwed onto the nodule.

3. A sub-assembly as claimed in claim 1 which includes means at the ends of the slats for attachment of the slats onto a frame.

4. A spring assembly comprising a frame, means securing the sub-assembly of claim 1 to the frame to extend in laterally spaced apart parallel relation therein, a border wire extending about the upper terminal coils of the outermost coil springs, and means interconnecting the uppermost terminal coils of the adjacent coil springs to the border wire.

5. A spring assembly as claimed in claim 4 in which the means interconnecting the border wire with the upper terminal coils of the coil springs comprises a helical tie wire encircling the adjacent terminal coils of the outermost coil springs and the border wire.

6. A spring assembly as claimed in claim 4 in which the means interconnecting the border wire to the upper terminal coil of the outermost coil springs comprises clip members.

* * * * *